United States Patent [19]

Todeschini

[11] 4,265,104

[45] May 5, 1981

[54] METHOD AND DEVICE FOR CUTTING A METAL STRIP SIMULTANEOUSLY INTO AT LEAST THREE CONTINUOUS COMB-SHAPED COMPONENTS

[75] Inventor: Giuseppe Todeschini, Olginate, Italy

[73] Assignee: Exfin, S.A., Lausanne, Switzerland

[21] Appl. No.: 16,129

[22] Filed: Feb. 26, 1979

[30] Foreign Application Priority Data

Mar. 13, 1978 [IT] Italy ..... 67543 A/78

[51] Int. Cl.[3] ..... B21D 28/08

[52] U.S. Cl. ..... 72/330; 72/337; 83/32; 83/405; 83/406

[58] Field of Search ..... 72/325, 331, 326, 327, 72/328, 329, 332, 337, 336, 203; 83/32, 102, 405, 406; 113/116 H, 116 L

[56] References Cited

U.S. PATENT DOCUMENTS

| | | | |
|---|---|---|---|
| 885,500 | 4/1908 | McKee | 72/366 X |
| 1,603,265 | 10/1926 | Beyer | 113/116 V UX |
| 1,942,043 | 1/1934 | Anderson | 83/32 |
| 2,159,355 | 5/1939 | Goetze | 113/116 V UX |
| 2,454,609 | 11/1948 | Miller | 83/32 |

*Primary Examiner*—Milton S. Mehr

*Attorney, Agent, or Firm*—George E. Kersey

[57] ABSTRACT

In a method for simultaneously cutting three continuous double-comb components from a metal strip the strip is moved forward stepwise. At each stop, a row of notches is made along each edge to form teeth and a row of crosses is removed from its central part, the crosses being made up of two portions of the central part and two teeth facing notches and separated therefrom by a portion of the central part. After the teeth have been bent, the comb-shaped components can be used to reinforce rubber packing or linings, more particularly in the car industry.

6 Claims, 8 Drawing Figures

METHOD AND DEVICE FOR CUTTING A METAL STRIP SIMULTANEOUSLY INTO AT LEAST THREE CONTINUOUS COMB-SHAPED COMPONENTS

DESCRIPTION

The invention relates to a method for simultaneously cutting a strip of metal into at least three continuous comb-shaped components, each having a central rib extending in the longitudinal direction of the strip, two opposite rows of equidistant lateral teeth extending from the rib.

The invention also relates to a device for working the aforementioned kind, comprising a longitudinal guide for the cut strip and punches and a corresponding die for the cutting operation.

The object of the invention is to provide a method of the aforementioned kind and a device for working the method, capable of making maximum use of the material in a metal strip.

This object is attained by the method and device as defined in the claims.

According to the method, the central comb-shaped component, as soon as it is cut, is pushed out of the plane of the two side components, thus preventing the side teeth of the central component from sticking in the corresponding notches in the side components, since this would make it very difficult or impossible to separate one component from the other.

The device according to the invention has the advantage that the method can be worked by very simple means which are easy and cheap to manufacture.

Other advantages of the invention will be clear from the following description of an embodiment of the device with reference to the accompanying drawings, which are given by way of example and in which.

Figure 3:
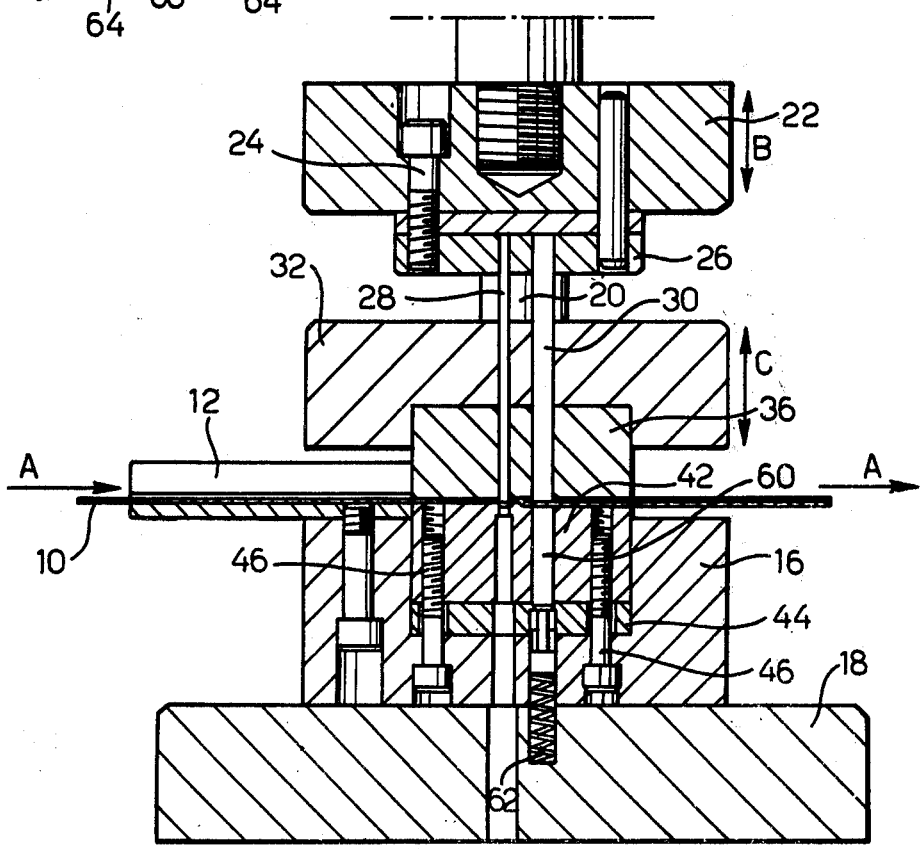
FIG. 3 is a longitudinal section through a device according to the invention.
Figure 4:
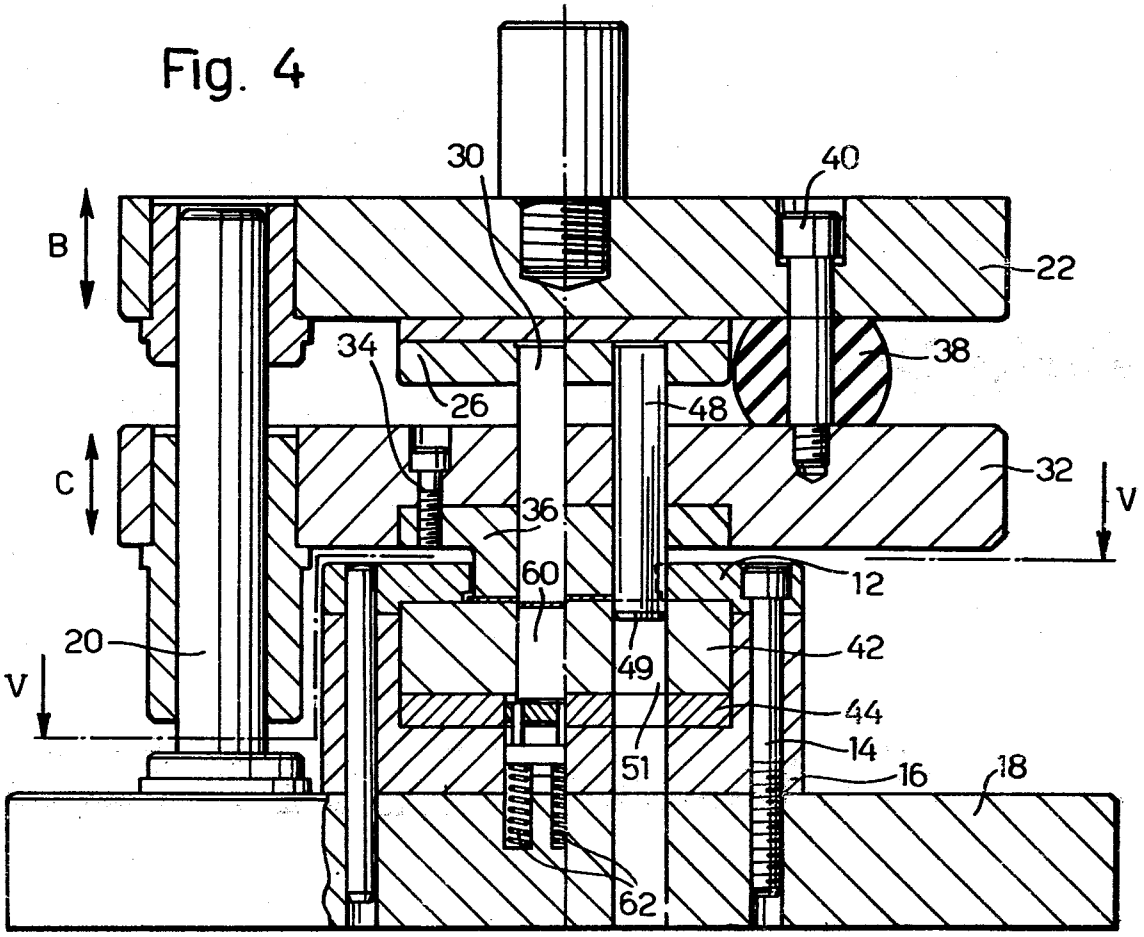
FIG. 4 is a cross-section of the device in FIG. 3.
Figure 5:
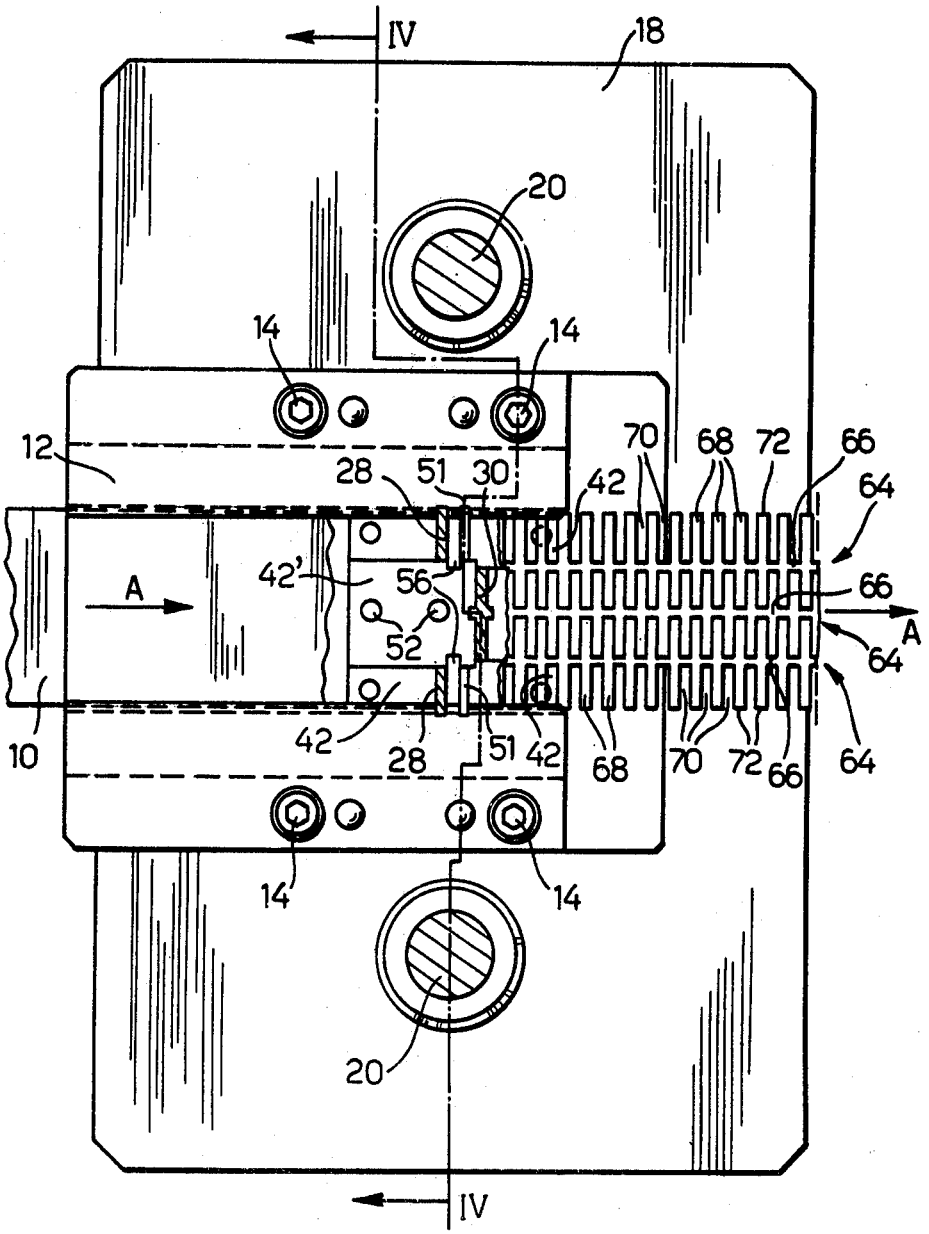
FIG. 5 is a top view of the bottom part of the device in FIG. 3.

As shown in FIGS. 3–5, the device for cutting a strip 10 comprises a central guide 12 for bearing and guiding the strip 10, which is conveyed through the device in direction A. Guide 12 is secured by bolts 14 to a die-holder 16 which is secured by bolts 14 to a bearing plate 18. Two cylindrical columns 20 are secured to plate 18 and their top ends vertically guide a top plate 22 in the direction of arrow B. A securing plate 26 is attached by screws 24 to the top part of plate 22 and bears the ends of two side punches 28 and a central punch 30. The central parts of punches 28 and 30 extend through respective recesses in an intermediate plate 32 to which a sheet-pressing means 36 is attached by screws 34. The intermediate plate 32 is connected to the top plate 22 by bolts 40 with interposition of two resilient pads 38. Plate 32 is vertically movable in the direction of arrow C relative to plate 22, and is guided in the same direction by the two cylindrical columns 20. The bottom ends of the three punches 28 and 30 co-operate with a die 42 borne by a bearing plate 44 secured by screws 46 to the die-holder 16.

The securing plate 26 bears punches 28 and 30 and also bears a pair of guide rods 48 having rounded bottom ends and adapted to enter respective cavities 51 in die 42.

Figure 6:
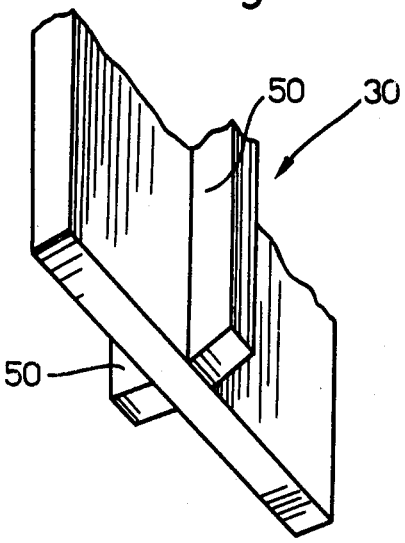
FIG. 6 is a larger-scale perspective view of the central cruciform punch.

The two punches 28 have a rectangular cross-section corresponding to the shape of the notches to be cut as will be described hereinafter in detail. As shown in FIG. 6, the central punch 30 is cruciform in plan view and has a pair of arms 50 having beveled bottom ends, so that the punch assembly has a substantially convex cross-section.

The central punch 30 co-operates with a central part 42' of die 42. Part 42' is secured by two screws 52 in a recess in die 42 and has two lateral grooves 54 which engage two respective projections 56 of die 42. The central part 42' can be inserted into the matrix in a predetermined position, i.e. by engaging projections 56 with grooves 54.

Figure 7:
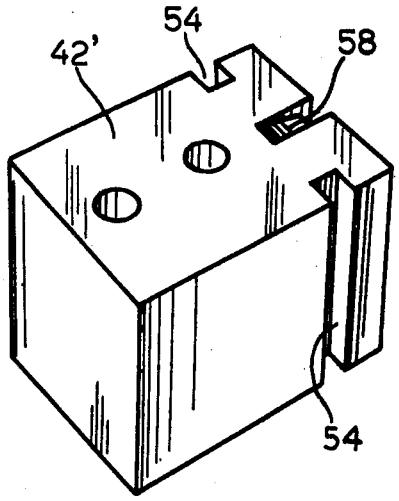
FIG. 7 is a perspective view of a part of the die which co-operates with the central punch in FIG. 6.
Figure 8:
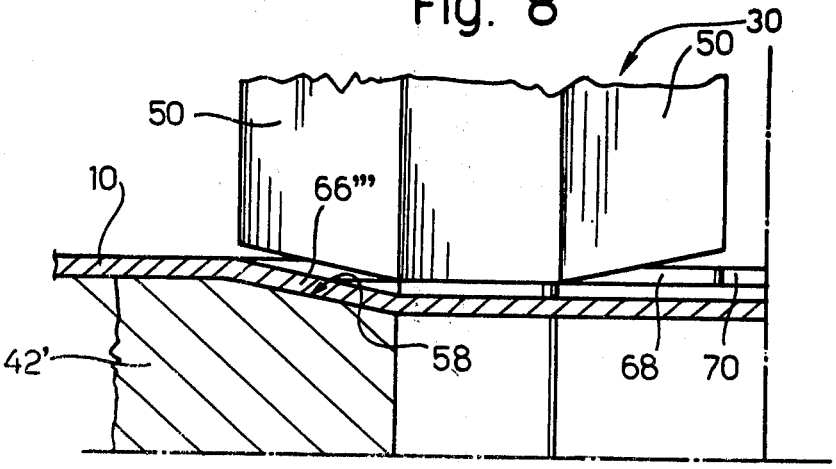
FIG. 8 is a longitudinal section through the central punch and the die.

As shown in FIG. 7, one edge of the central part 42' of die 42 has a bevelled recess 58 which cooperates with one arm 50 of punch 30.

An extractor 60 is mounted in a groove in die 42 opposite punch 30 and can move against the action of a spring 62 in the direction of motion of the central punch 30, i.e. in the direction of arrow B.

Figure 1:
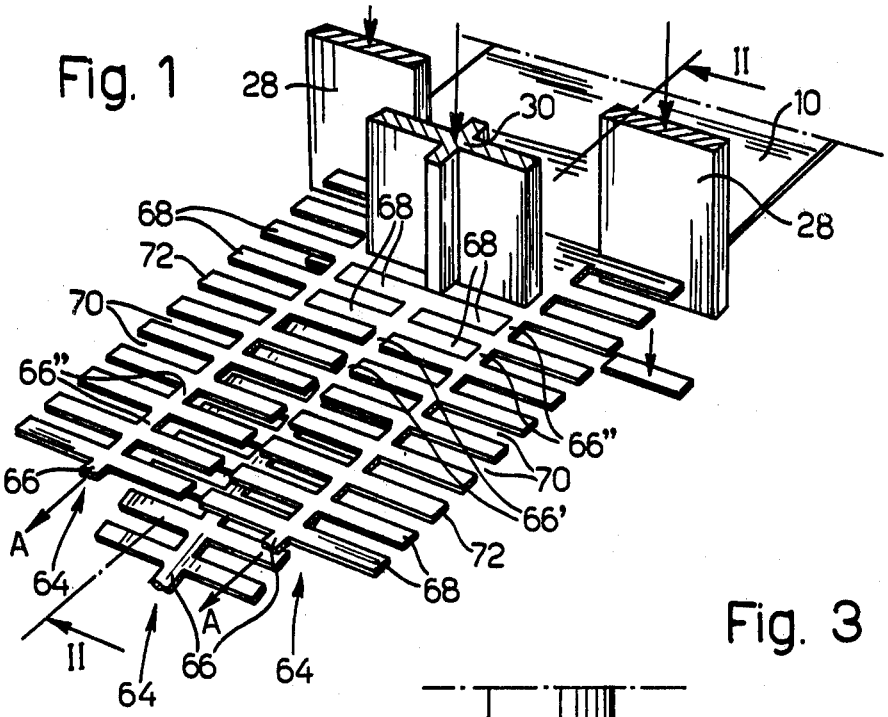
FIG. 1 is a perspective view of a partly cut strip.
Figure 2:
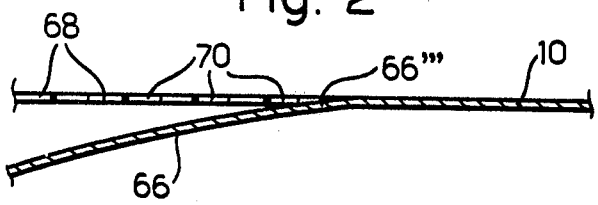
FIG. 2 is a section along line II—II of FIG. 1.

The aforementioned device is adapted to cut strip 10 simultaneously into three comb-shaped components 64 as shown in FIGS. 1 and 2. Each component 64 has a central rib 66 which extends in the longitudinal direction of strip 10 and from which two opposite rows of equidistant side teeth 68 extend. The comb-shaped components 64 are for use, e.g. as a reinforcement for rubber packing or linings, after the teeth 68 have been bent towards one another.

The two side punches 28 cut rows of rectangular notches 70 from two side regions of strip 10, which is conveyed stepwise in the direction A through the previously-described device. The punches thus form two side rows of rectangular teeth 68, each having a free end 72. At the moment when each pair of notches 70 is cut, the central cruciform punch 30 cuts a cross from the centre of strip 10. The cross is made up of two portions 66' of the central rib 66 and two rectangular teeth 68, each facing one of the side notches 70 and separated therefrom by a rib portion 66''. Punch 30 is separated from the two side punches 28 in the direction A of motion of strip 10, so that the side notches 70 are cut two steps before the respective crosses are cut.

After two pairs of side notches 70 have been cut, strip 10 is moved forward one step and the rounded ends 49 of the two guide rods 48, which are slightly wider than punches 28, successively enter the two side notches 70 which have just been cut, thus adjusting the strip exactly in position before the next cutting operation.

Arm 50 of the cruciform central punch 30 has a substantially convex cross-section which co-operates with the concave cross-section (i.e. the bevelled recess 58) of part 42' of the die. Consequently, at the moment when each cross is cut, that portion 66' of the central rib 66 which is connected to the not yet cut part of strip 10 is pushed out of the plane of the two side components 64. As a result, the central comb-shaped component 64 is not left sticking between the teeth 68 of the two side components 64.

When the central punch 30 is withdrawn, extractor 60 rises under the action of spring 62, thus pushing the newly-cut cross out of die 42.

The central part 42' formed with the bevelled recess 58, is removable from die 52 and consequently the die can easily be adapted to the shape which it is desired to cut, simply by changing its central part 42'.

Only one arm 50 of the central punch 30 is used in co-operation with the bevelled recess 38. The symmetrical shape of the punch is advantageous in that the punch can be rotated through 180° in order to use the other arm 50 after a certain period in use and before it shows signs of wear.

Of course, the invention is not limited to the simultaneous cutting of three components only, but can be similarly used for cutting e.g. five comb-shaped components from a single strip 10. Teeth 68 and notches 70 of comb-shaped components 64 can be non-rectangular, e.g. triangular.

I claim:

1. The method of cutting a strip of metal into at least three continuous comb-shaped components simultaneously, comprising the steps of:

(a) advancing the strip stepwise in a plane;

(b) cutting a parallel row of side notch arms in opposite edges of the strip each time it stops;

(c) cutting a continuous member from the central portion of the strip and forcing the member below the plane of the remainder of the strip; and (d) cutting said continuous member from side arms parallel to said side notch arms and forcing the cut portion of said continuous member below the plane of said notch arms; thereby to prevent the side arms of said continuous member from becoming entangled with said side components.

2. The method of claim 1 wherein said side notch arms are cut at least one step before said arms of said continuous member cut from the plane of said strip.

3. The method of claim 2 wherein said continuous member is cut by a cruciform punch.

4. Apparatus for cutting a strip of metal into a plurality of separate components, comprising a longitudinal guide for the strip to be cut;

two side punches for cutting notches in opposite edges of said strip;

a central cruciform punch for cutting a continuous member from said strip, said punch having bevelled faces for engaging the continuous portion of said member.

5. Apparatus as defined in claim 4 wherein said cruciform punch cooperates with a removable die.

6. Apparatus as defined in claim 5 wherein the removable die has a bevelled recess which cooperates with a bevelled face of said punch.

* * * * *